US009115319B2

(12) United States Patent
Subramaniyam

(10) Patent No.: US 9,115,319 B2
(45) **Date of Patent: *Aug. 25, 2015**

(54) ADDITIVE FOR NAPHTHENIC ACID CORROSION INHIBITION AND METHOD OF USING THE SAME

(75) Inventor: Mahesh Subramaniyam, Mumbai (IN)

(73) Assignee: Dorf Ketal Chemicals (I) Private Limited, Mumbai (IN)

( * ) Notice: Subject to any disclaimer, the term of this patent is extended or adjusted under 35 U.S.C. 154(b) by 526 days.

This patent is subject to a terminal disclaimer.

(21) Appl. No.: 12/677,791

(22) PCT Filed: Sep. 12, 2008

(86) PCT No.: PCT/IN2008/000586

§ 371 (c)(1),
(2), (4) Date: Mar. 11, 2010

(87) PCT Pub. No.: WO2009/063496

PCT Pub. Date: May 22, 2009

(65) Prior Publication Data

US 2010/0264064 A1 Oct. 21, 2010

(30) Foreign Application Priority Data

Sep. 14, 2007 (IN) ..... 1769/MUM/2007

(51) Int. Cl.

| | |
|---|---|
| ***C10G 75/02*** | (2006.01) |
| ***C10L 1/26*** | (2006.01) |
| ***C10L 10/04*** | (2006.01) |
| ***C10M 137/14*** | (2006.01) |
| *C10L 1/188* | (2006.01) |

(52) U.S. Cl.

CPC . *C10G 75/02* (2013.01); *C10L 1/26* (2013.01); *C10L 1/2616* (2013.01); *C10L 10/04* (2013.01); *C10M 137/14* (2013.01); *C10G 2300/1033* (2013.01); *C10G 2300/202* (2013.01); *C10G 2300/203* (2013.01); *C10G 2300/4075* (2013.01); *C10G 2300/80* (2013.01); *C10L 1/1886* (2013.01); *C10L 1/265* (2013.01); *C10L 1/2683* (2013.01); *C10L 1/2691* (2013.01); *C10M 2207/16* (2013.01); *C10M 2223/065* (2013.01); *C10N 2230/12* (2013.01)

(58) Field of Classification Search

CPC ..... C10G 9/16; C10G 75/04; C10G 75/00; C10G 75/02; C10G 2300/4075; C10G 7/10; C10G 49/005

USPC ..... 208/48 AA, 265, 47, 48 R, 48 Q

See application file for complete search history.

(56) References Cited

U.S. PATENT DOCUMENTS

| | | | | |
|---|---|---|---|---|
| 1,872,091 | A | | 8/1932 | Mougey |
| 2,316,078 | A | | 4/1943 | Loane et al. |
| 2,316,087 | A | | 4/1943 | Gaynor et al. |
| 2,688,612 | A | * | 9/1954 | Watson ..... 562/9 |
| 2,915,517 | A | | 12/1959 | Le Suer |
| 3,132,975 | A | | 5/1964 | Freud |
| 3,145,886 | A | | 8/1964 | Goodwin |
| 3,201,438 | A | | 8/1965 | Reed |
| 3,260,622 | A | | 7/1966 | Le Suer |
| 3,281,359 | A | | 10/1966 | Oberender et al. |
| 3,324,032 | A | | 6/1967 | O'Halloran |
| 3,428,561 | A | | 2/1969 | Lesuer |
| 3,459,662 | A | | 8/1969 | Hu |
| 3,460,989 | A | | 8/1969 | Rusch |
| 3,489,682 | A | | 1/1970 | Lesuer |
| 3,531,394 | A | | 9/1970 | Koszman |
| 3,663,637 | A | * | 5/1972 | Juhl et al. ..... 208/255 |

(Continued)

FOREIGN PATENT DOCUMENTS

| | | |
|---|---|---|
| EP | 0565285 B1 | 5/1997 |
| EP | 1063276 A1 | 12/2000 |

(Continued)

OTHER PUBLICATIONS

Foreign communication from a related counterpart application—International Search Report and Written Opinion, PCT/IN2008/000586, Aug. 24, 2009, 6 pages.

Foreign communication from a related counterpart application—International Preliminary Report on Patentability, PCT/IN2008/000586, Mar. 16, 2010, 5 pages.

Foreign communication from a related counterpart application—International Search Report and Written Opinion, PCT/IB2009/053736, Feb. 9, 2010, 11 pages.

Foreign communication from a related counterpart application—International Preliminary Report on Patentability, PCT/IB2009/053736, Oct. 18, 2010, 20 pages.

(Continued)

*Primary Examiner* — Michelle Stein

(74) *Attorney, Agent, or Firm* — Conley Rose, P.C.; Rodney B. Carroll

(57) ABSTRACT

The present invention relates to the field of processing hydrocarbons which causes corrosion in the metal surfaces of processing units. The invention addresses the technical problem of high temperature naphthenic acid corrosion and sulphur corrosion and provides a solution to inhibit these types of corrosion. The three combination compositions are formed by two mixtures separately, with one mixture obtained by mixing compound A, which is obtained by reacting high reactive polyisobutylene (HRPIB) with phosphorous pentasulphide in presence of catalytic amount of sulphur with compound B which is thiophosphorous compound such as phosphorous thioacid ester of Formula (1) and second mixture obtained by mixing compound A with compound C of Formula (2) which is obtained by reacting compound B with ethylene oxide, wherein each of these two mixtures independently provide high corrosion inhibition efficiency in case of high temperature naphthenic acid corrosion inhibition and sulphur corrosion inhibition. The invention is useful in all hydrocarbon processing units, such as, refineries, distillation columns and other petrochemical industries.

25 Claims, No Drawings

(56) References Cited

U.S. PATENT DOCUMENTS

| | | | | |
|---|---|---|---|---|
| 3,668,237 | A | 6/1972 | Cyba | |
| 3,909,447 | A | 9/1975 | Redmore et al. | |
| 4,024,049 | A | 5/1977 | Shell et al. | |
| 4,024,050 | A | 5/1977 | Shell et al. | |
| 4,105,540 | A | 8/1978 | Weinland | |
| 4,443,609 | A | 4/1984 | Oude Alink et al. | |
| 4,542,253 | A | 9/1985 | Kaplan et al. | |
| 4,578,178 | A | 3/1986 | Forester | |
| 4,600,518 | A | 7/1986 | Ries et al. | |
| 4,842,716 | A | 6/1989 | Kaplan et al. | |
| 4,906,391 | A | 3/1990 | Andress | |
| 4,927,561 | A | 5/1990 | Forester | |
| 4,941,994 | A | 7/1990 | Zetlmeisl et al. | |
| 5,182,013 | A | 1/1993 | Petersen et al. | |
| 5,252,254 | A | 10/1993 | Babaian-Kibala | |
| 5,314,643 | A * | 5/1994 | Edmondson et al. | 208/47 |
| 5,484,542 | A | 1/1996 | Cahoon et al. | |
| 5,500,107 | A | 3/1996 | Edmondson | |
| 5,552,085 | A | 9/1996 | Babaian-Kibala | |
| 5,611,991 | A | 3/1997 | Naraghi | |
| 5,630,964 | A | 5/1997 | Babaian-Kibala et al. | |
| 5,725,611 | A | 3/1998 | Wright et al. | |
| 5,863,415 | A | 1/1999 | Zetlmeisl | |
| 6,512,133 | B1 | 1/2003 | Götzmann et al. | |
| 2002/0107150 | A1 | 8/2002 | Mikami et al. | |
| 2003/0201207 | A1 * | 10/2003 | Eaton et al. | 208/265 |
| 2004/0087450 | A1 * | 5/2004 | Boffa | 508/185 |
| 2005/0044778 | A1 | 3/2005 | Orr | |
| 2005/0234184 | A1 | 10/2005 | Doring et al. | |
| 2007/0119747 | A1 | 5/2007 | Harrell et al. | |
| 2010/0116718 | A1 | 5/2010 | Subramaniyam | |
| 2010/0126842 | A1 | 5/2010 | Subramaniyam | |
| 2011/0160405 | A1 | 6/2011 | Subramaniyam | |
| 2011/0214980 | A1 | 9/2011 | Subramaniyam | |

FOREIGN PATENT DOCUMENTS

| | | | |
|---|---|---|---|
| GB | 190608667 | | 0/1907 |
| GB | 792553 | | 3/1958 |
| WO | 2006049980 | A2 | 5/2006 |
| WO | 2008005058 | A1 | 1/2008 |
| WO | 2008120236 | A2 | 10/2008 |
| WO | 2008120236 | A3 | 10/2008 |
| WO | 2008122989 | A2 | 10/2008 |
| WO | 2008122989 | A3 | 10/2008 |
| WO | 2008122989 | A4 | 10/2008 |
| WO | 2009063496 | A2 | 5/2009 |
| WO | 2009063496 | A3 | 5/2009 |
| WO | 2010023621 | A2 | 3/2010 |
| WO | 2010023621 | A3 | 3/2010 |
| WO | 2010023628 | A1 | 3/2010 |

OTHER PUBLICATIONS

Foreign communication from a related counterpart application—International Search Report and Written Opinion, PCT/IB2009/053726, Jun. 17, 2010, 15 pages.

Foreign communication from a related counterpart application—International Preliminary Report on Patentability, PCT/IB2009/053726, Dec. 7, 2010, 14 pages.

Foreign communication from a related counterpart application—International Search Report and Written Opinion, PCT/IN 2008/000217, Mar. 23, 2009, 8 pages.

Foreign communication from a related counterpart application—International Preliminary Report on Patentability, PCT/IN2008/000217, Oct. 6, 2009, 7 pages.

Foreign communication from a related counterpart application—International Search Report and Written Opinion, PCT/IN2008/000195, Mar. 25, 2009, 7 pages.

Foreign communication from a related counterpart application—International Preliminary Report on Patentability, PCT/IN2008/000195, Oct. 6, 2009, 6 pages.

Office Action dated Oct. 11, 2013 (17 pages), U.S. Appl. No. 12/593,622, filed Sep. 29, 2009.

Office Action (Final) dated Mar. 19, 2013 (16 pages), U.S. Appl. No. 12/593,622, filed Sep. 29, 2009.

Office Action dated Jul. 23, 2012 (16 pages), U.S. Appl. No. 12/593,622 filed, Sep. 29, 2009.

Office Action (Restriction Requirement) dated May 2, 2012 (7 pages), U.S. Appl. No. 12/593,622, filed Sep. 29, 2009.

Office Action (Final) dated Sep. 5, 2013 (13 pages), U.S. Appl. No. 13/061,045, filed Feb. 25, 2011.

Office Action dated Jan. 29, 2013 (40 pages), U.S. Appl. No. 13/061,045, filed Feb. 25, 2011.

Office Action (Restriction Requirement) dated Dec. 7, 2012 (7 pages), U.S. Appl. No. 13/061,045, filed Feb. 25, 2011.

Office Action (Final) dated May 13, 2013 (12 pages), U.S. Appl. No. 12/594,320, filed Oct. 1, 2009.

Office Action dated Aug. 13, 2012 (15 pages), U.S. Appl. No. 12/594,320, filed Oct. 1, 2009.

Office Action (Restriction Requirement) dated Mar. 8, 2012 (9 pages), U.S. Appl. No. 12/594,320, filed Oct. 1, 2009.

Foreign communication from a related counterpart application—Intention to Grant, European Patent Application No. 09787015.8, Mar. 27, 2014, 48 pages.

Office Action (Final) dated May 22, 2014 (24 pages), U.S. Appl. No. 12/593,622, filed Sep. 29, 2009.

Abou El Naga, H. H., et al., "Succinimide Phosphoric Acid Esters as Multipurpose Additives," XP002565966, Lubrication Science, Jul. 1994, pp. 351-361, vol. 6, No. 4.

Office Action dated Apr. 3, 2014 (20 pages), U.S. Appl. No. 13/061,045, filed Feb. 25, 2011.

* cited by examiner

ADDITIVE FOR NAPHTHENIC ACID CORROSION INHIBITION AND METHOD OF USING THE SAME

CROSS-REFERENCE TO RELATED APPLICATIONS

This application is a U.S. national phase application filed under 35 U.S.C. §371 of the International Application No. PCT/IN2008/000586, filed on Sep. 12, 2008, designating the United States, which claims priority from Indian Patent Application No. 1769/MUM/2007, filed on Sep. 14, 2007, which are hereby incorporated herein by reference in their entirety for all purposes.

FIELD OF THE INVENTION

The present invention relates to the inhibition of metal corrosion in acidic hot hydrocarbons and more particularly to the inhibition of corrosion of iron-containing metals in hot acidic hydrocarbons, especially when the acidity is derived from the presence of naphthenic acid.

DISCUSSION OF PRIOR ART

It is widely known in the art that the processing of crude oil and its various fractions has led to damage to piping and other associated equipment due to naphthenic acid corrosion. These are corrosive to the equipment used to distill, extract, transport and process the crudes. Generally speaking, naphthenic acid corrosion occurs when the crude being processed has a neutralization number or total acid number (TAN), expressed as the milligrams of potassium hydroxide required to neutralize the acids in a one gram sample, above 0.2. It is also known that naphthenic acid-containing hydrocarbon is at a temperature between about 200.degree. C. and 400.degree. C. (approximately 400.degree. F.-750.degree. F.), and also when fluid velocities are high or liquid impinges on process surfaces e.g. in transfer lines, return bends and restricted flow areas.

Corrosion problems in petroleum refining operations associated with naphthenic acid constituents and sulfur compounds in crude oils have been recognized for many years. Such corrosion is particularly severe in atmospheric and vacuum distillation units at temperatures between 400.degree. F. and 790.degree. F. Other factors that contribute to the corrosivity of crudes containing naphthenic acids include the amount of naphthenic acid present, the concentration of sulfur compounds, the velocity and turbulence of the flow stream in the units, and the location in the unit (e.g., liquid/vapor interface).

As commonly used, naphthenic acid is a collective term for certain organic acids present in various crude oils. Although there may be present minor amounts of other organic acids, it is understood that the majority of the acids in naphthenic based crude are naphthenic in character, i.e., with a saturated ring structure as follows:

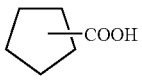

The molecular weight of naphthenic acid can extend over a large range. However, the majority of the naphthenic acid from crude oils is found in gas oil and light lubricating oil. 15 When hydrocarbons containing such naphthenic acid contact iron-containing metals, especially at elevated temperatures, severe corrosion problems arise.

Naphthenic acid corrosion has plagued the refining industry for many years. This corroding material consists of predominantly monocyclic or bicyclic carboxylic acids with a boiling range between 350.degree. and 650.degree. F. These acids tend to concentrate in the heavier fractions during crude distillation. Thus, locations such as the furnace tubing, transfer lines, fractionating tower internals, feed and reflux sections of columns, heat exchangers, tray bottoms and condensers are primary sites of attack for naphthenic acid. Additionally, when crude stocks high in naphthenic acids are processed, severe corrosion can occur in the carbon steel or ferritic steel furnace tubes and tower bottoms. Recently interest has grown in the control of this type of corrosion in hydrocarbon processing units due to the presence of naphthenic acid in crudes from locations such as China, India, Africa and Europe.

Crude oils are hydrocarbon mixtures which have a range of molecular structures and consequent range of physical properties. The physical properties of naphthenic acids which may be contained in the hydrocarbon mixtures also vary with the changes in molecular weight, as well as the source of oil containing the acid. Therefore, characterization and behavior of these acids are not well understood. A well known method used to "quantify" the acid concentration in crude oil has been a KOH titration of the oil. The oil is titrated with KOH, a strong base, to an end point which assures that all acids in the sample have been neutralized. The unit of this titration is mg. of KOH/gram of sample and is referred to as the "Total Acid Number" (TAN) or Neutralization Number. Both terms are used interchangeably in the application.

The unit of TAN is commonly used since it is not possible to calculate the acidity of the oil in terms of moles of acid, or any other of the usual analytical terms for acid content. Refiners have used TAN as a general guideline for predicting naphthenic acid corrosion. For example, many refineries blend their crude to a TAN=0.5 assuming that at these concentrations naphthenic acid corrosion will not occur. However, this measure has been unsuccessful in preventing corrosion by naphthenic acid.

Naphthenic acid corrosion is very temperature dependent. The generally accepted temperature range for this corrosion is between 205.degree. C. and 400.degree. C. (400.degree. F. and 750.degree. F.). Corrosion attack by, these acids below 205.degree. C. has not yet been reported in the published literature. As to the upper boundary, data suggests that corrosion rates reach a maximum at about 600.degree.-700.degree. F. and then begin to diminish.

The concentration and velocity of the acid/oil mixture are also important factors which influence naphthenic acid corrosion. This is evidenced by the appearance of the surfaces affected by naphthenic acid corrosion. The manner of corrosion can be deduced from the patterns and color variations in the corroded surfaces. Under some conditions, the metal surface is uniformly thinned. Thinned areas also occur when condensed acid runs down the wall of a vessel. Alternatively, in the presence of naphthenic acid pitting occurs, often in piping or at welds. Usually the metal outside the pit is covered with a heavy, black sulfide film, while the surface of the pit is bright metal or has only a thin, grey to black film covering it. Moreover, another pattern of corrosion is erosion-corrosion, which has a characteristic pattern of gouges with sharp edges. The surface appears clean, with no visible by-products. The pattern of metal corrosion is indicative of the fluid flow within the system, since increased contact with surfaces allows for a greater amount of corrosion to take place. Therefore, corrosion patterns provide information as to the method of corrosion which has taken place. Also, the more complex the corrosion, i.e., in increasing complexity from uniform to pitting to erosion-corrosion, the lower is the TAN value which triggers the behavior.

The information provided by corrosion patterns indicates whether naphthenic acid is the corroding agent, or rather if the process of corrosion occurs as a result of attack by sulfur. Most crude contain hydrogen sulfide, and therefore readily form iron sulfide films on carbon steel. In all cases that have been observed in the laboratory or in the field, metal surfaces have been covered with a film of some sort. In the presence of hydrogen sulfide the film formed is invariably iron sulfide, while in the few cases where tests have been run in sulfur free conditions, the metal is covered with iron oxide, as there is always enough water or oxygen present to produce a thin film on the metal coupons.

Tests utilized to determine the extent of corrosion may also serve as indicators of the type of corrosion occurring within a particular hydrocarbon treating unit. Metal coupons can be inserted into the system. As they are corroded, they lose material. This weight loss is recorded in units of mg/cm-.sup.2. Thereafter, the corrosion rate can be determined from weight loss measurements. Then the ratio of corrosion rate to corrosion product (mpy/mg/cm.sup.2) is calculated. This is a further indicator of the type of corrosion process which has taken place, for if this ratio is less than 10, it has been found that there is little or no contribution of naphthenic acid to the corrosion process. However, if the ratio exceeds 10, then naphthenic acid is a significant contributor to the corrosion process.

Distinguishing between sulfidation attack and corrosion caused by naphthenic acid is important, since different remedies are required depending upon the corroding agent. Usually, retardation of corrosion caused by sulfur compounds at elevated temperatures is effected by increasing the amount of chromium in the alloy which is used in the hydrocarbon treating unit. A range of alloys may be employed, from 1.25% Cr to 12% Cr, or perhaps even higher. Unfortunately, these show little to no resistance to naphthenic acid. To compensate for the corroding effects of sulfur and naphthenic acid, an austenitic stainless steel which contains at least 2.5% molybdenum, must be utilized. The corrosive problem is known to be aggravated by the elevated temperatures necessary to refine and crack the oil and by the oil's acidity which is caused primarily by high levels of naphthenic acid indigenous to the crudes. Naphthenic acids is corrosive between the range of about 175 degree C. to 420.degree. C. At the higher temperatures the naphthenic acids are in the vapor phase and at the lower temperatures the corrosion rate is not serious. The corrosivity of naphthenic acids appears to be exceptionally serious in the presence of sulfide compounds, such as hydrogen sulfide, mercaptans, elemental sulfur, sulfides, disulfides, polysulfides and thiophenols. Corrosion due to sulfur compounds becomes significant at temperatures as low as 450.degree. F. The catalytic generation of hydrogen sulfide by thermal decomposition of mercaptans has been identified as a cause of sulfidic corrosion.

Sulfur in the crudes, which produces hydrogen sulfide at higher temperatures, also aggravates the problem. The temperature range of primary interest for this type of corrosion is in the range of about 175.degree. C. to about 400.degree. C., especially about 205.degree. C. to about 400.degree. C.

Various approaches to controlling naphthenic acid corrosion have included neutralization and/or removal of naphthenic acids from the crude being processed; blending low acid number oils with corrosive high acid number oils to reduce the overall neutralization number; and the use of relatively expensive corrosion-resistant alloys in the construction of the piping and associated equipment. These attempts are generally disadvantageous in that they require additional processing and/or add substantial costs to treatment of the crude oil. Alternatively, various amine and amide based corrosion inhibitors are commercially available, but these are generally ineffective in the high temperature environment of naphthenic acid corrosion. Naphthenic acid corrosion is readily distinguished from conventional fouling problems such as coking and polymer deposition which can occur in ethylene cracking and other hydrocarbon processing reactions using petroleum based feedstocks. Naphthenic acid corrosion produces a characteristic grooving of the metal in contact with the corrosive stream. In contrast, coke deposits generally have corrosive effects due to carburization, erosion and metal dusting.

Because these approaches have not been entirely satisfactory, the accepted approach in the industry is to construct the distillation unit, or the portions exposed to naphthenic acid/sulfur corrosion, with the resistant metals such as high quality stainless steel or alloys containing higher amounts of chromium and molybdenum. The installation of corrosion-resistant alloys is capital intensive, as alloys such as 304 and 316 stainless steels are several times the cost of carbon steel. However, in units not so constructed there is a need to provide inhibition treatment against this type of corrosion. The prior art corrosion inhibitors for naphthenic acid environments include nitrogen-based filming corrosion inhibitors. However, these corrosion inhibitors are relatively ineffective in the high temperature environment of naphthenic acid oils.

While various corrosion inhibitors are known in various arts, the efficacy and usefulness of any particular corrosion inhibitor is dependent on the particular circumstances in which it is applied. Thus, efficacy or usefulness under one set of circumstances often does not imply the same for another set of circumstances. As a result, a large number of corrosion inhibitors have been developed and are in use for application to various systems depending on the medium treated, the type of surface that is susceptible to the corrosion, the type of corrosion encountered, and the conditions to which the medium is exposed. For example, U.S. Pat. No. 3,909,447 describes certain corrosion inhibitors as useful against corrosion in relatively low temperature oxygenated aqueous systems such as water floods, cooling towers, drilling muds, air drilling and auto radiator systems. That patent also notes that many corrosion inhibitors capable of performing in non-aqueous systems and/or non-oxygenated systems perform poorly in aqueous and/or oxygenated systems. The reverse is true as well. The mere fact that an inhibitor that has shown efficacy in oxygenated aqueous systems does not suggest that it would show efficacy in a hydrocarbon. Moreover, the mere fact that an inhibitor has been efficacious at relatively low temperatures does not indicate that it would be efficacious at elevated temperatures. In fact, it is common for inhibitors that are very effective at relatively low temperatures to become ineffective at temperatures such as the 175.degree. C. to 400.degree. C. encountered in oil refining. At such temperatures, corrosion is notoriously troublesome and difficult to alleviate. Thus, U.S. Pat. No. 3,909,447 contains no teaching or suggestion that it would be effective in non-aqueous systems such as hydrocarbon fluids, especially hot hydrocarbon fluids. Nor is there any indication in U.S. Pat. No. 3,909,447 that the compounds disclosed therein would be effective against naphthenic acid corrosion under such conditions.

Atmospheric and vacuum distillation systems are subject to naphthenic acid corrosion when processing certain crude oils. Currently used treatments are thermally reactive at use temperatures. In the case of phosphorus-based inhibitors, this is thought to lead to a metal phosphate surface film. The film is more resistant to naphthenic acid corrosion than the base steel. These inhibitors are relatively volatile and exhibit fairly narrow distillation ranges. They are fed into a column above or below the point of corrosion depending on the temperature range. Polysulfide inhibitors decompose into complex mixtures of higher and lower polysulfides and, perhaps, elemental sulfur and mercaptans. Thus, the volatility and protection offered is not predictable.

The problems caused by naphthenic acid corrosion in refineries and the prior art solutions to that problem have been described at length in the literature, the following of which are representative:

U.S. Pat. No. 3,531,394 to Koszman described the use of phosphorus and/or bismuth compounds in the cracking zone of petroleum steam furnaces to inhibit coke formation on the furnace tube walls.

U.S. Pat. No. 3,531,394 to Koszman described the use of phosphorus and/or bismuth compounds in the cracking zone of petroleum steam furnaces to inhibit coke formation on the furnace tube walls.

U.S. Pat. No. 4,024,049 to Shell et al discloses compounds substantially as described and claimed herein for use as refinery antifoulants. While effective as antifoulant materials, materials of this type have not heretofore been used as corrosion inhibitors in the manner set forth herein. While this reference teaches the addition of thiophosphate esters such as those used in the subject invention to the incoming feed, due to the non-volatile nature of the ester materials they do not distill into the column to protect the column, the pumparound piping, or further process steps. I have found that by injecting the thiophosphate esters as taught herein, surprising activity is obtained in preventing the occurrence of naphthenic acid corrosion in distillation columns, pumparound piping, and associated equipment.

U.S. Pat. No. 4,105,540 to Weinland describes phosphorus containing compounds as antifoulant additives in ethylene cracking furnaces. The phosphorus compounds employed are mono- and di-ester phosphate and phosphite compounds having at least one hydrogen moiety complexed with an amine.

U.S. Pat. No. 4,443,609 discloses certain tetrahydrothiazole phosphonic acids and esters as being useful as acid corrosion inhibitors. Such inhibitors can be prepared by reacting certain 2,5-dihydrothiazoles with a dialkyl phosphite. While these tetrahydrothiazole phosphonic acids or esters have good corrosion and inhibition properties, they tend to break down during high temperature applications thereof with possible emission of obnoxious and toxic substances.

It is also known that phosphorus-containing compounds impair the function of various catalysts used to treat crude oil, e.g., in fixed-bed hydrotreaters and hydrocracking units. Crude oil processors are often in a quandary since if the phosphite stabilizer is not used, then iron can accumulate in the hydrocarbon up to 10 to 20 ppm and impair the catalyst. Although nonphosphorus-containing inhibitors are commercially available, they are generally less effective than the phosphorus-containing compounds.

U.S. Pat. No. 4,542,253 to Kaplan et al, described an improved method of reducing fouling and corrosion in ethylene cracking furnaces using petroleum feedstocks including at least 10 ppm of a water soluble mine complexed phosphate, phosphite, thiophosphate or thiophosphite ester compound, wherein the amine has a partition coefficient greater than 1.0 (equal solubility in both aqueous and hydrocarbon solvents).

U.S. Pat. No. 4,842,716 to Kaplan et al describes an improved method for reducing fouling and corrosion at least 10 ppm of a combination of a phosphorus antifoulant compound and a filming inhibitor. The phosphorus compound is a phosphate, phosphite, thiophosphate or thiophosphite ester compound. The filming inhibitor is an imidazoline compound.

U.S. Pat. No. 4,941,994 Zetmeisl et al discloses a naphthenic acid corrosion inhibitor comprising a dialkyl or trialkylphosphite in combination with an optional thiazoline.

A significant advancement in phosphorus-containing naphthenic acid corrosion inhibitors was reported in U.S. Pat. No. 4,941,994, in which the present inventor is identified as a co-inventor. Therein it is disclosed that metal corrosion in hot acidic liquid hydrocarbons is inhibited by the presence of a corrosion inhibiting amount of a dialkyl and/or trialkyl phosphite with an optional thiazoline.

While the method described in U.S. Pat. No. 4,941,994 provides significant improvements over the prior art techniques, nevertheless, there is always a desire to enhance the ability of corrosion inhibitors while reducing the amount of phosphorus-containing compounds which may impair the function of various catalysts used to treat crude oil, as well as a desire for such inhibitors that may be produced from lower cost or more available starting materials.

Another approach to the prevention of naphthenic acid corrosion is the use of a chemical agent to form a barrier between the crude and the equipment of the hydrocarbon processing unit. This barrier or film prevents corrosive agents from reaching the metal surface, and is generally a hydrophobic material. Gustavsen et al. NACE Corrosion 89 meeting, paper no. 449, Apr. 17-21, 1989 details the requirements for a good filming agent. U.S. Pat. No. 5,252,254 discloses one such film forming agent, sulfonated alkyl-substituted phenol, and effective against naphthenic acid corrosion.

U.S. Pat. No. 5,182,013 issued to Petersen et al. on Jan. 26, 1993 describes another method of inhibiting naphthenic acid corrosion of crude oil, comprising introducing into the oil an effective amount of an organic polysulfide. The disclosure of U.S. Pat. No. 5,182,013 is incorporated herein by reference. This is another example of a corrosion-inhibiting sulfur species. Sulfidation as a source of corrosion was detailed above. Though the process is not well understood, it has been determined that while sulfur can be an effective anti-corrosive agent in small quantities, at sufficiently high concentrations, it becomes a corrosion agent.

Phosphorus can form an effective barrier against corrosion without sulfur, but the addition of sulfiding agents to the process stream containing phosphorus yields a film composed of both sulfides and phosphates. This results in improved performance as well as a decreased phosphorus requirement. This invention pertains to the deliberate addition of sulfiding agents to the process stream when phosphorus-based materials are used for corrosion control to accentuate this interaction.

U.S. Pat. No. 5,314,643 to Edmondson et al., describes a process for inhibition of corrosion caused by naphthenic acid and sulphur compounds during the elevated temperature processing of crude oil by use of a corrosion inhibitor consisting of a combination of trialkylphosphate and an alkaline earth metal phosphonate-phenate sulphide, functioning effectively as an inhibitor on the internal metallic surfaces of the equipment used in crude oil refining operations.

Organic polysulfides (Babaian-Kibala, U.S. Pat. No. 5,552,085), organic phosphites (Zetlmeisl, U.S. Pat. No. 4,941,994), and phosphate/phosphite esters (Babaian-Kibala, U.S. Pat. No. 5,630,964), have been claimed to be effective in hydrocarbon-rich phase against naphthenic acid corrosion. However, their high oil solubility incurs the risk of distillate side stream contamination by phosphorus.

Phosphoric acid has been used primarily in aqueous phase for the formation of a phosphate/iron complex film on steel surfaces for corrosion inhibition or other applications (Coslett, British patent 8,667, U.S. Pat. Nos. 3,132,975, 3,460,989 and 1,872,091). Phosphoric acid use in high temperature non-aqueous environments (petroleum) has also been reported for purposes of fouling mitigation (U.S. Pat. No. 3,145,886).

There remains a continuing need to develop additional options for mitigating the corrosivity of acidic crudes at lower cost. This is especially true at times of low refining margins and a high availability of corrosive crudes from sources such as Europe, China, or Africa, and India. The present invention addresses this need.

OBJECTS AND ADVANTAGES OF PRESENT INVENTION

Accordingly, the objects and advantages of the present invention are described below.

An object of present invention is to provide a novel additive chemical composition which will provide very effective inhibitor for naphthenic acid corrosion inhibition as well as sulphur corrosion inhibition.

Another object of the present invention is to provide a novel additive having a corrosion inhibiting composition, which is very stable even at high temperature. Yet another object of the present invention is to provide a novel additive having a corrosion inhibiting composition, having very low acid value.

SUMMARY OF INVENTION

The present invention relates to the field of processing hydrocarbons which causes corrosion in the metal surfaces of processing units. The invention addresses the technical problem of high temperature naphthenic acid corrosion and sulphur corrosion and provides a solution to inhibit these types of corrosion. The three combination compositions are formed by two mixtures separately, with one mixture obtained by mixing compound A, which is obtained by reacting high reactive polyisobutylene (HRPIB) with phosphorous pentasulphide in presence of catalytic amount of sulphur with compound B which is thiophosphorous compound such as phosphorous thioacid ester of Formula 1 and second mixture obtained by mixing compound A with compound C of Formula 2 which is obtained by reacting compound B with ethylene oxide, wherein each of these two mixtures independently provide high corrosion inhibition efficiency in case of high temperature naphthenic acid corrosion inhibition and sulphur corrosion inhibition. The invention is useful in all hydrocarbon processing units, such as, refineries, distillation columns and other petrochemical industries.

DESCRIPTION OF THE INVENTION

It has been surprisingly discovered by the inventor of the present invention, that a combination of organophosphorus sulphur compound and other phosphorus compound such as, phosphorous thioacid compound, that is, thiophosphite and/or thiophosphite esters, is very efficiently functioning in controlling naphthenic acid corrosion, providing a synergetic effect of combination of phosphorous compounds. The organophosphorus sulphur compound (A) is made from reaction of polyisobutylene with, phosphorus pentasulphide, in presence of sulphur powder. The other chemical compound (B), that is, phosphorous thioacid compound is made by reaction of alcohol and phosphorous pentasulphide. The chemical compound (C) is made by reacting the chemical compound (B) with cyclic oxides, such as ethylene oxide.

The most effective amount of the corrosion inhibitor to be used in accordance with the present invention can vary depending on the local operating conditions and the particular hydrocarbon being processed. Thus, the temperature and other characteristics of the acid corrosion system can have a bearing on the amount of inhibitor or mixture of inhibitors to be used. Generally, where the operating temperatures and/or the acid concentrations are higher, a proportionately higher amount of the corrosion inhibitor will be required. It has been found that the concentration of the corrosion inhibitors or mixture of inhibitors added to the crude oil may range from about 1 ppm to 5000 ppm. It has also been found that it is preferred to add the inhibitors at a relatively high initial dosage rate of 2000-3000 ppm and to maintain this level for a relatively short period of time until the presence of the inhibitor induces the build-up of a corrosion protective coating on the metal surfaces.

Once the protective surface is established, the dosage rate needed to maintain the protection may be reduced to a normal operational range of about 100-1500 ppm without substantial sacrifice of protection.

The inventor of the present invention has carried out extensive experimentation to verify the effectiveness of corrosion-inhibitors in case naphthenic acid corrosion inhibition, by experimenting with combinations of inhibitor-compounds A, B, and C, with different proportions of additive compound (A), that is, polyisobutylene plus phosphorus pentasulphide plus sulphur powder and either of compound (B) and (C). Experiments were also preformed by using compound (A) alone and compound (B) alone and compound (C) alone separately. The methods used in and results of all these experiments are presented in Examples 1 to 6 and Tables 1 to 5.

The reacted compound (A) is obtained by reaction of olefins with $P_2S_5$ (Phosphorus pentasulphide) in presence of sulphur powder. The preferred olefins have double bonds, wherein double bond is present internally or terminally.

The example of internally double bonded olefins include beta-olefins.

The example of terminally double bonded olefins include alpha-olefins. These olefins have 5 to 30 carbon atoms. These olefins are alternatively, polymeric olefins such as high reactive polyisobutylene containing greater than 70% of vinyledene double bond, and normal polysobutylenes which contains Vinyl, vinyledene, and such other groups of chemicals.

The ratio of $P_2S_5$ to Olefin is preferably 0.05 to 2 mole of $P_2S_5$ to 1 mole of Olefins. The Sulphur powder is present in catalytic quantity, that is, sulphur powder is 0.5% to 5% of Olefin by weight.

Method of Synthesis of Additive Compound A

The most preferred embodiment of the present invention is described below:

A weighed quantity of HRPIB (High Reactive Polyisobutylene), phosphorous pentasulphide and sulphur powder are charged into a clean four-necked round bottom flask, equipped with nitrogen inlet, stirrer and thermometer, thereby forming a reaction mixture.

This reaction mixture is stirred and heated to temperature of 160° C. under nitrogen gas purging. At this temperature of 160° C., the reaction leads to evolution of hydrogen sulphide gas ($H_2S$). The temperature of the reaction mixture is now maintained between 160° C. to 180° C., for a period of 1 hour to 2 hours. Then the temperature of the mixture is raised to 220° C. The reaction mixture is then maintained at this temperature of 220° C. for 6 hours.

The resultant reaction mass is then cooled to temperature of 100° C., when nitrogen gas is purged into the resultant reaction mass, to drive out the hydrogen sulphide present therein. The resulting polyisobutylene phosphorous sulphur compound, which is the additive compound A of the present invention, is used as a high temperature naphthenic acid corrosion inhibitor. This compound is used neat or diluted in appropriate solvent such as xylene, toluene, and aromatic solvent as any other appropriate solvent to achieve inhibition of high temperature naphthenic acid corrosion.

Method of Synthesis of Additive Compound B

The present invention is not specially concerned with the manner of thiophosphate and thiophosphite ester preparation. Thiophosphate ester compounds are readily prepared as the reaction product, for example, of phosphorous pentasulphide ($P_2S_5$) and an alcohol and/or thio in a suitable solvent.

N-octanol is charged into a clean four-necked-flask, which is equipped with stirrer, nitrogen gas inlet and condenser. Appropriate amount of phosphorous pentasulphide is added to the flask in installments. The molar ratio of N-octanol to $P_2S_5$ is between 2:1 to 4:1. After raising the temperature to 85° C. to 135° C., the $H_2S$ gas is seen to evolve. After one hour the reaction mixture is heated to 115° C. to 165° C. and the flask is maintained at that temperature for 1 hour to 3 hours. The sample is cooled and filtered through typically 5 micron filter. The filtered sample is then heated to 65° C. to 115° C. The nitrogen gas is now purged for 3 to 7 hours. The resulting compound is the additive compound B2 of the present invention. The additive compound B 2 is tested for its efficiency for naphthenic acid corrosion inhibition. The additive compound (A+B2) is also tested for its efficiency for naphthenic acid corrosion inhibition. The method of synthesis of additive compound B2 is explained in Example 3.

Method of Synthesis of Additive Compound C

The additive compound B2 is transferred to the autoclave and ethylene oxide is added at 15° C. to 50° C. till the pressure in the autoclave remains constant, thereby indicating no further absorption of the ethylene oxide by the reactions mixture. The acid value of the final product is 25 mg/KOH. After addition of ethylene oxide, the reaction mixture is maintained at 35° C. to 85° C. for 3 to 7 hours. The nitrogen gas is then purged for further 3 to 7 hours duration. The resulting sample, that is, additive compound C2 is filtered and tested for its efficiency in naphthenic acid corrosion inhibition. The efficiency of the combination additive compound (A+C2) is also tested. The method of synthesis of additive compound C2 is illustrated in Example 4.

The present invention is directed to a method for inhibiting corrosion on the metal surfaces of the processing units which process hydrocarbons such as crude oil and its fractions containing naphthenic acid. The invention is explained in details in its simplest form wherein the following method steps are carried out, when it is used to process crude oil in process units such as distillation unit. Similar steps can be used in different processing units such as, pumparound piping, heat exchangers and such other processing units.

These method steps are explained below:

a) heating the hydrocarbon containing naphthenic acid to vaporize a portion of the hydrocarbon:
b) allowing the hydrocarbon vapors to rise in a distillation column;
c) condensing a portion of the hydrocarbon vapours passing through the distillation column to produce a distillate;
d) adding to the distillate, from 5 to 2000 ppm of a combination (A)+(B) additive compound [(or a combination of (A)+(C)] additive compound of instant invention;
e) allowing the distillate containing combination (A)+(B) additive compound [or a combination of (A)+(C) additive compound] to contact substantially the entire metal surfaces of the distillation unit to form protective film on such surface, whereby such surface is inhibited against corrosion.

It is advantageous to treat distillation column, trays, pumparound piping and related equipment to prevent naphthenic acid corrosion, when condensed vapours from distilled hydrocarbon fluids contact metallic equipment at temperatures greater than 200° C., and preferably greater than 400° C. The combination (A)+(B) additive compound or the combination (A)+(C) compound additive is generally added to the condensed distillate and the condensed distillate is allowed to contact the metallic surfaces of the distillation column, packing, trays, pump around piping and related equipment as the condensed distillate passes down the column and into the distillation vessel. The distillate may also be collected as product. The corrosion inhibitors of the instant invention remain in the resultant collected product.

In commercial practice, the additives of this invention may be added to a distillate return to control corrosion in a draw tray and in the column packing while a second injection may be added to a spray oil return immediately below the draw trays to protect the tower packing and trays below the distillate draw tray. It is not so critical where the additive of the invention is added as long as it is added to distillate that is later returned to the distillation vessel, or which contact the metal interior surfaces of the distillation column, trays, pump around piping and related equipments.

The method of making and using the polyisobutylene phosphorous sulphur compound that is, additive compound A of the present invention for achieving inhibition of high temperature naphthenic acid corrosion is explained below with the help of examples 1 and 5.

Discussion about Unexpected Surprising Synergistic Technical Effects of Very High Efficiency in Naphthenic Acid Corrosion Inhibition by Use of Additive Compound of Present Invention.

The method of using the additive compound of the present invention, that is, the thiophosphate esters and derivatives thereof, in combination with the polyisobutylene phosphorous sulphur compound of the present invention, for achieving inhibition of high temperature naphthenic acid corrosion is explained below with the help of examples 1 to 6.

The detailed discussion given below with respect to the results presented in Table 1 to 5 for experiments described in Examples 1 to 6 explains the effectiveness of the additive compound of present invention in high temperature, naphthenic acid corrosion inhibition or sulphur corrosion inhibition.

B2 represents a form of additive compound B obtained under particular operating conditions of synthesis.

C1, C2 represents different forms of additive compound C obtained under different operating conditions of synthesis.

Referring to Table 1 where molar ratio of HRPIB to phosphorous pentasulphide was 1:1, it is observed that, in the static test, as the effective dosage of additive compound A of the present invention was increased from 200 ppm to 400 ppm, the corrosion inhibition efficiency, as calculated by formula given in Example 5 2, increased from 55.7529% to 99.6783%.

Referring to Table 2, it is observed that, the compound C1 of the present invention, when used in isolation, in two separate total dosages of 150 ppm and 180 ppm (wherein 50% was active dosage), the corrosion inhibition efficiency increased respectively from above 55% to above 76%. When compound C1 was used in combination with compound A in two separate total dosages of 300 ppm and 360 ppm (with ratio of A:C1 as 1:1, and when each of dosages of A and C1, was 50% active), the corrosion inhibition efficiency increased from above 90% to above 99%.

Referring to Table 3, it is observed that, the compound C2 of the present invention, when used in isolation, in total dosage of 90 ppm (wherein 50% was active dosage), the corrosion inhibition efficiency was above 60%. When the compound C 2 was used in combination with compound A in five separate total dosages ranging between 200 ppm and 400 ppm, (with ratio of A:C2 varying from 1.22:1 to 3.44:1 and when each of dosages of A and C2 was 50% active), the corrosion inhibition efficiency which ranged between above 85% and above 98%.

Referring to Table 4, it is observed that, the compound B2 of the present invention, when used in isolation, in two separate total dosages of 90 ppm and 180 ppm (wherein 50% was active dosage), the corrosion inhibition efficiency was above 49% and above 75% respectively. When the compound B2 was used in combination with compound A in total dosage of 400 ppm (with ratio of A:B2 as 3.44:1, and when each of dosages of A and B2 was 50% active) the corrosion inhibition efficiency was above 85%.

Referring to Table 5, in the High Temperature Naphthenic Acid Corrosion Dynamic Test, it is observed that, the compound A of the present invention, when used in isolation (Expt. 18 and 19), in total two separate dosages separately of 20 ppm (Expt. 19) and 50 ppm (Expt. 18) (wherein 50% was active dosage), the corrosion inhibition efficiency was above 19% (Expt. 19) and 54% (Expt. 18) respectively. When the compound C2 was used in combination with compound A, in three separate total dosages from 40 ppm (Expt. 22), 60 ppm (Expt. 21) and 90 ppm (Expt. 20), (with ratio of A:C2 varying from 1:1 to 1.25:1 and when each of dosages of A and C2 was 50% active) the corrosion inhibition efficiency varied between above 77% and 100%, confirming synergistic effect of combination of compound A and compound C (specific compound C2).

Thus it is seen from the earlier discussion that the additive compound of present invention used for corrosion-inhibition has the following important distinguishing features, as compared to the prior art.

1) The inventor of the present invention, after extensive experimentation, has surprisingly found that the additive compounds used by the inventor, that is, additive compound (A+B) and additive compound (A+C) are the POLYMERIC ADDITIVES, which are highly effective in high temperature corrosion inhibition.
   The prior-art does not teach or suggest use of a polymeric additive in naphthenic acid corrosion inhibition or sulphur corrosion inhibition or any corrosion inhibition, in general.
2) Another distinguishing feature of the additive compound of present invention is that it has more thermal stability as compared to the additive compounds taught by the prior-art, due to the polymeric nature of the additive compound of present invention. Due to its high thermal stability the additive compound of present invention is very effective in high temperature naphthenic corrosion inhibition or high temperature sulphur corrosion.
3) Yet another distinguishing feature of the additive compound of present invention is that, it has very low acidity as compared to the additive compounds of prior art, for example, the phosphate esters of prior art has very high acidity. The phosphate esters of prior art are known to have a tendency to decompose, even at lower temperatures, to form phosphoric acids, which travel further along the hydrocarbon stream and react with metal surfaces of equipments such as packing of distillation column, to form solid iron phosphate. These solids plug the holes of equipments and thereby lead to fouling of distillation column.
   The additive compound of the present invention does not have this deficiency.
4) The distinguishing features between U.S. Pat. No. 5,552,085 and the present invention are described below. Referring to the results of experiments given in Table 1 (examples 5 and 6) of U.S. Pat. No. 5,552,085, and comparing the results of NTPE and NNTPE, it is seen that there is no effect of neutralization at dosage of 500 ppm and TAN of 4.5 mg/KOH, as the corrosion inhibition rates are same. Further, comparing results of example 3 and 4, given in the same Table 1, it is seen that corrosion inhibition rate decreases when neutralized or treated thiophosphoric acid compounds are used. These data will teach away from use of neutralizing or treating thiophosphoric acid compounds, when they are used for corrosion inhibition. The present invention teaches that reacting thiophosphoric acid compound with ethylene oxide and using the treated compound for inhibiting corrosion, improves the efficiency of corrosion inhibition, when used singularly or in combination with compound A.

Example 1

Synthesis of Polymeric Organophosphorous Sulphur Compound—Additive Compound A The weighed quantities of 68.16 gm of commercially available HRPIB (High Reactive Polyisobutylene with molecular weight 950 approximately), 30.31 gm of Phosphorous Pentasulphide and 1.51 gm of Sulphur Powder are charged into a clean four necked round bottom flask, equipped with $N_2$ inlet, stirrer and thermometer, thereby forming a reaction mixture. This gives 1:1 mole ratio of Phosphorous Pentasulphide to Olefin.

The reaction mixture was stirred and heated to 160° C. temperature under nitrogen gas purging. The purging of $N_2$ gas led to removal of hydrogen sulphide gas, which was generated during the reaction. The temperature of the reaction mixture was maintained between 160° C. to 180° C., for a period of 1 hour to 2 hours. Then the temperature of the mixture was raised to 220° C. and the mixture was maintained at this temperature for 6 to 10 hours.

The resultant reaction mass was then cooled to 100° C. when nitrogen gas was purged into it, to drive out the hydrogen sulphide gas present therein. The resulting polyisobutylene phosphorous sulphur compound was used as a high temperature naphthenic acid corrosion inhibitor, as well as, sulphur corrosion inhibitor. This compound was used neat or diluted in appropriate solvent such as xylene, toluene, and aromatic solvent as well as any other appropriate solvent to achieve inhibition of high temperature naphthenic acid corrosion as well as sulphur corrosion.

The above mentioned synthesis is carried out for different mole ratios of HRPIB to Phosphorous Pentasulphide. A similar synthesis was carried out by using normal polyisobutylene instead of HRPIB.

The resulting polyisobutylene phosphorous sulphur compound was tested for its napthenic acid corrosion inhibition efficiency. The testing method is presented in Example 5. The results are presented in Table 1 at Experiment Numbers 2, 3 and 4.

Example 2

Synthesis of Additive Compound C1 and Napthenic Acid Corrosion Inhibition Efficiency Testing of Additive Compound (A+C1) Using Static Test Method The clean four-necked-flask was equipped with stirrer, nitrogen gas inlet and condenser. N-noctanol weighing 400 gms was charged, in the flask. The phosphorous pentasulphide weighing 187 gms, was then added to the flask in installments. The temperature of the flask was then increased to 110° C. The $H_2S$ gas was seen to be evolved after addition of $P_2S_5$. After one hour, the reaction mixture in the flask was heated to 140° C. and the flask was maintained at that temperature for one hour. The acid value of the reaction mixture was about 125 mg/KOH. The reaction mixture that is compound B1 was then transferred to the autoclave, and ethylene oxide was added till the pressure remained constant, thereby indicating no further absorption of the ethylene oxide by the reaction mixture. The system was then purged with nitrogen gas to remove the excess of ethylene oxide. The acid value of the final product was about 25 mg/KOH. The resulting compound of example 2 that is compound C1 was tested for its naphthenic acid corrosion efficiency. The efficiency of combination compound (A+C1) was also tested. All of these results are presented in Table 2 at Experiment Numbers 5, 6, 7 and 8.

Example 3

Synthesis of Additive Compound B2 and Naphthenic Acid Corrosion Inhibition Efficiency Testing of Additive Compound (A+B2) Using Static Test Method The clean four-necked-flask was equipped with stirrer, nitrogen gas inlet and condenser. N-noctanol weighing 400 gms was charged in the flask. Phosphorous pentasulphide weighing 187 gms, was then added to the flask in installments. The temperature of the flask was then increased to 110° C. The $H_2S$ gas was seen to be evolved after addition of $P_2S_5$. After one hour, the reaction mixture in the flask was heated to 140° C. and the flask was maintained at that temperature for one hour. The sample was cooled and filtered through 5 micron filter. The sample was heated to 90° C. The nitrogen gas was purged for 5 hours. The resulting sample, that is compound B2 was analyzed for its acid value, which was found to be between 110 to 130 mg/KOH. The compound B2 was tested for its naphthenic acid corrosion efficiency. The efficiency of the combination compound (A+B2) was also tested. The testing method is presented in Example 5. The results are presented in Table 4 at Experiment numbers 15, 16 and 17.

Example 4

Synthesis of Additive Compound C2 and Naphthenic Acid Corrosion Inhibition Efficiency Testing of Additive Compound (A+C2) Using Static Test Method This resulting reaction mixture of Example 3, that is, Compound B2, was then transferred to the autoclave, and ethylene oxide was added at 30° C. till the pressure remained constant, thereby indicating no further absorption of the ethylene oxide by the reaction mixture. The acid value of the final product was about 25 mg/KOH. After addition of ethylene oxide, the reaction mixture was maintained at 60° C. for 5 hours. The nitrogen gas was then purged for further 5 hours duration. The sample, that is, compound C2, was filtered and tested for its efficiency in naphthenic acid corrosion inhibition. The efficiency of combination compound (A+C2) was also tested. The testing method is presented in Example 5. The results are presented in Table 3 at Experiment Numbers 9 to 14.

Example 5

High Temperature Naphthenic Acid Corrosion Test (Static Test)

In this example, various amounts of a 50% formulation of the composition prepared in accordance, with Example 1, and invention-compounds prepared in accordance with Examples 2 to 4 were tested for corrosion inhibition efficiency on steel coupons in hot oil containing naphthenic acid. A weight loss coupon, immersion test was used to evaluate the invention compound for its effectiveness in inhibition of naphthenic acid corrosion at 290° C. temperature. Different dosages of compounds were used, as 50% active solution, as shown in Tables 1 to 4.

A static test on steel coupon was conducted without using any additive. This test provided a blank test reading.

The reaction apparatus consisted of a one-liter four necked round bottom flask equipped with water condenser, $N_2$ purger tube, thermometer pocket with thermometer and stirrer rod. 600 gm (about 750 ml) paraffin hydrocarbon oil (D-130) was taken in the flask. $N_2$ gas purging was started with flow rate of 100 cc/minute and the temperature was raised to 100° C., which temperature was maintained for 30 minutes. A compound of example 1 comprising Polyisobutylene and Phosphorous Pentasulphide with sulphur powder was added to the reaction mixture. The reaction mixture was stirred for 15 minutes at 100° C. temperature. After removing the stirrer, the temperature of the reaction mixture was raised to 290° C. A pre-weighed weight-loss carbon steel coupon CS 1010 with dimensions 76 mm . . . times 13 mm . . . times 1.6 mm was immersed. After maintaining this condition for 1 hour to 1.5 hours, 31 gm of naphthenic acid (commercial grade with acid value of 230 mg/KOH) was added to the reaction mixture. A sample of one gm weight of reaction mixture was collected for determination of acid value, which was found to be approximately 11.7 mg/KOH. This condition was maintained for four hours. After this procedure, the metal coupon was removed, excess oil was rinsed away, the excess corrosion product was removed from the metal surface. Then the metal coupon was weighed and the corrosion rate was calculated in mils per year.

Similar method was used for testing the efficiency of naphthenic acid corrosion inhibition of other compounds. The results are presented in Table 1 to 4.

Calculation of Corrosion Inhibition Efficiency.

The method used in calculating Corrosion Inhibition Efficiency is given below. In this calculation, corrosion inhibition efficiency provided by additive compound is calculated by comparing weight loss due to additive with weight loss of blank coupon (without any additive).

$$\text{Corrosion Inhibition Efficiency} = \frac{(\text{Weight loss for blank without additive}) - (\text{weight loss with additive})}{(\text{weight loss for blank without additive})} \times 100$$

The corrosion rate in MPY (mils per year) is calculated by the formula, $$MPY = \frac{534 \times \text{Weight loss in mg}}{(\text{Density in gm/cc}) \times (\text{Area in } in^2) \times (\text{Time of test in hours})}$$

Example 6

High Temperature Naphthenic Acid Corrosion Dynamic Test

The dynamic testing was carried out by using rotating means provided in the temperature-controlled autoclave and was carried out by using passivated steel coupons. A dynamic test on steel coupon was conducted without using any additive o passivation. This test provided a blank test reading.

A weight-loss coupon immersion dynamic test was used to evaluate the additive compounds A and (A+C2) for effectiveness in inhibition of naphthenic acid corrosion at 290° C. temperature in dynamic condition.

The following test equipment and materials were used in the Dynamic Corrosion Test:

2. Temperature controlled autoclave
3. Preweighed weight-loss carbon steel coupons CS 1010 with dimensions 76 mm . . . times 13 mm . . . times 1.6 mm.
4. Means to rotate the coupon, to provide a peripheral velocity in excess of 3 m/second.

Material:

1. Paraffin hydrocarbon oil (D-130-Distilled residue) with naphthenic acid added to provide an acid neutralization number of approximately 2 mg/KOH.
2. Nitrogen gas in the vapour space.

Two pre-weighed weight-loss carbon steel coupons, were clamped to the rotating means of the autoclave. The dynamic test was conducted at 290° C. for 4 hours. After the test, the coupons were removed, excess oil was rinsed away, excess corrosion product was removed from the surface of coupons. The coupons were then weighed and the corrosion rate was calculated as mils/year. The results of these dynamic tests are presented in Table 5. The detailed steps of the dynamic test procedure are given below:

1. Take 400 gms of paraffin hydrocarbon oil D-130 (distilled residue) in the autoclave.
2. Add desired dosage of invention additive compound and mix well.
3. Mount the pre-weighed coupons in the autoclave, and set the temperature to 120° C.
4. Start heating and keep the stirring at 500 rpm with continuous nitrogen gas purging (bubbling) and after few minutes further increase the rpm of stirrer speed to 1000 rpm.
5. Increase temperature of heating to 160° C. and stop nitrogen gas purging,
6. Now raise the temperature to 290° C. and let the autoclave run at temperature 290° C. for 2 hours (the passivation time).
7. Lower the temperature to 100° C.
8. Open the reactor and add the naphthenic acid for achieving acid value of TAN 2.0 mg/KOH (the naphthenic acid is 3.35 gm with acid value of 237 mg/KOH).
9. Stir the sample and collect 2 to 3 ml of naphthenic acid for TAN measurement.
10. Close the autoclave and start heating by raising temperature to 290° C. and stir the mixture at 1000 rpm, for 4 hours.
11. Cool the reactor to 100° C.
12. Remove the coupon and clean it initially with toluene/hexane and finally with acetone.
13. Dry the coupon for 5 minutes at 120° C. and keep it in the desicator.
14. Weigh the coupon
15. Calculate the naphthenic acid corrosion inhibition efficiency.
16. The results of the dynamic tests are presented at the Experiment Numbers 18 to 22 in Table 5.

TABLE 1

| Experiment Sr. No. | Inhibitor | Dosage in ppm | Weight loss in mg | Corrosion Rate MPY | Corrosion Inhibitors Efficiency in % |
|---|---|---|---|---|---|
| 1 | Only metal Blank (No inhibitor Compound) | — | 89.5 | 447.95 | — |
| 2 | 50% active Compound of Example 1, (Polyisobutylene, Phosphorus penta sulphide and sulphur powder) and 50% solvent | 200 | 63.3 | 316.82 | 29.27 |
| 3 | Compound as per experiment No. 2 | 300 | 39.6 | 198.20 | 55.75 |
| 4 | Compound as per experiment No. 2 | 400 | 15.2 | 76.08 | 83.02 |

TABLE 2

| Experiment Sr. No. | Compound (A) dosage in ppm (50% was active) | Compound (C1)dosage in ppm (50% was active) | Ratio (A):(C1) | Total Dosage in ppm | Weight loss in mg. | Corrosion Rate MPY | Corrosion Inhibitor Efficiency in % |
|---|---|---|---|---|---|---|---|
| 2 | 200 | — | — | 200 | 63.3 | 316.82 | 29.27 |
| 3 | 300 | — | — | 300 | 39.6 | 198.20 | 55.75 |
| 4 | 400 | — | — | 400 | 15.2 | 76.08 | 83.02 |
| 5 | — | 150 | — | 150 | 39.6 | 198.20 | 55.75 |
| 6 | — | 180 | — | 180 | 21.1 | 105.61 | 76.43 |
| 7 | 150 | 150 | 1:1 | 300 | 8.1 | 40.54 | 90.95 |
| 8 | 180 | 180 | 1:1 | 360 | 0.2 | 1.001 | 99.78 |

TABLE 3

| Experiment Sr. No. | Compound (A) dosage in ppm (50% was active) | Compound (C2)dosage in ppm (50% was active) | Ratio (A):(C2) | Total Dosage in ppm | Weight loss in mg. | Corrosion Rate MPY | Corrosion Inhibitor Efficiency in % |
|---|---|---|---|---|---|---|---|
| 2 | 200 | — | — | 200 | 63.3 | 316.82 | 29.27 |
| 3 | 300 | — | — | 300 | 39.6 | 198.20 | 55.75 |
| 4 | 400 | — | — | 400 | 15.2 | 76.08 | 83.02 |
| 9 | — | 90 | — | 90 | 35.0 | 175.18 | 60.89 |
| 10 | 310 | 90 | 3.44:1 | 400 | 1.3 | 6.51 | 98.55 |
| 11 | 180 | 120 | 1.5:1 | 300 | 10.1 | 50.55 | 88.72 |
| 12 | 110 | 90 | 1.22:1 | 200 | 13.2 | 66.07 | 85.25 |
| 13 | 230 | 120 | 1.92:1 | 350 | 6.4 | 32.03 | 92.85 |
| 14 | 280 | 120 | 2.33:1 | 400 | 2.6 | 13.01 | 97.10 |
| 23 | — | 150 | — | 150 | 24.1 | 120.63 | 73.07 |
| 24 | — | 180 | — | 180 | 10.0 | 50.05 | 88.83 |

TABLE 4

| Experiment Sr. No. | Compound (A) dosage in ppm (50% was active) | Compound (B2)dosage in ppm (50% was active) | Ratio (A):(B2) | Total Dosage in ppm | Weight loss in mg. | Corrosion Rate MPY | Corrosion Inhibitor Efficiency in % |
|---|---|---|---|---|---|---|---|
| 2 | 200 | — | — | 200 | 63.3 | 316.82 | 29.27 |
| 3 | 300 | — | — | 300 | 39.6 | 198.20 | 55.75 |
| 4 | 400 | — | — | 400 | 15.2 | 76.08 | 83.02 |
| 15 | — | 90 | — | 90 | 45 | 225.23 | 49.72 |
| 16 | — | 180 | — | 180 | 22 | 110.11 | 75.42 |
| 17 | 310 | 90 | 3.44:1 | 400 | 12.7 | 63.56 | 85.81 |

TABLE 5

| Experiment Sr. No. | Compound (A) dosage in ppm (50% was active) | Compound (C2)dosage in ppm (50% was active) | Ratio (A):(C2) | Total Dosage in ppm | Weight loss in mg. | Corrosion Rate MPY | Corrosion Inhibitor Efficiency in % |
|---|---|---|---|---|---|---|---|
| 23 | blank | nil | nil | nil | 7.5 | 37.53 | — |
| 18 | 50 | — | — | 50 | 3.45 | 17.27 | 54.0 |
| 19 | 20 | — | — | 20 | 6.05 | 30.28 | 19.33 |
| 20 | 50 | 40 | 1.25:1 | 90 | 0 | 0 | 100.0 |
| 21 | 30 | 30 | 1:1 | 60 | 0.7 | 3.5 | 90.67 |
| 22 | 20 | 20 | 1:1 | 40 | 1.7 | 8.51 | 77.33 |

In view of the details given in foregoing description of the present invention, it will be apparent to a person skilled in the art that the present invention basically comprises the following items:

Item 1

A novel additive for naphthenic acid corrosion inhibition comprising a chemical mixture of corrosion inhibiting amount of an olefin phosphorous sulphur compound A with corrosion inhibiting amount of any one of thiophosphorous sulphur compounds such as compound B and compound C, wherein said olefin phosphorous sulphur compound A is produced by reacting said olefin with phosphorous pentasulphide in presence of catalytic amount of sulphur, capably forming a reaction mixture, with molar ratio of said olefin to said phos phorous pentasulphide being between 1:0.05 to 1:1.5, preferably being 1:1;

and wherein said compound B is a thiophosphorous compound such as phosphorous thioacid ester of the formula 1

Formula 1

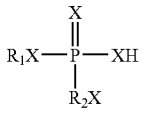

wherein X is independently either sulphur or oxygen and at least one X is sulphur and wherein $R_1$ and $R_2$ are hydrogen or hydrocarbyl having 5 to 18 carbon atoms and includes mono-, di-, mixtures thereof;

wherein said compound C of the formula 2 is obtained by reacting said compound B with an oxide selected from the group consisting of ethylene oxide, propylene oxide and butylene oxide and wherein the formula 2 comprises resulting compound C obtained after reaction of said compound B with said ethylene oxide, and includes mono-, di-, mixtures thereof;

Formula 2

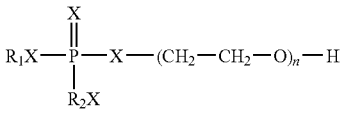

$n$ = 1 to 10

Item 2

A novel additive as described in item 1, wherein said olefin is polyisobutylene, which is either high reactive or normal.

Item 3

A novel additive, as described in item 1 and 2, wherein said olefin Phosphorus sulphur compound is arrived at, by stirring and heating said reaction mixture of item 1, to 160° C. under nitrogen gas purging, maintaining said reaction mixture between about 160° C. to about 180° C. for a period of about 1 hour to about 2 hours, raising temperature of said reaction mixture to from about 185° C. to about 250° C., preferably from about 190° C. to about 230° C., more preferably from about 210° C. to about 225° C. and maintaining said reaction mixture with raised temperature for about 1 to about 24 hours, preferably for about 6 to about 10 hours, cooling the reaction mass to 100° C. and purging nitrogen gas into reaction vessel to drive out the hydrogen sulphide gas, thereby resulting into said composition.

Item 4

A novel additive according to any one of the preceding items wherein said olefin has between 10 and 1000 carbon atoms.

Item 5

A novel additive according to any one of the preceding items wherein said olefin has a molecular weight of from 200 to 10,000.

Item 6

A novel additive according to any one of the preceding items wherein said olefin has a molecular weight of about 950 to about 1300.

Item 7

A novel additive, as described in item 1, wherein the amount of said mixture of said compound A and said compound B, which should be added to crude oil for high temperature naphthenic acid corrosion inhibition, is from about 1 ppm to about 5000 ppm, preferably from about 1 ppm to about 300 ppm.

Item 8

A novel additive, as described in item 7, wherein the ratio of said compound A to said compound B, by weight, is from about 1:1 to about 4:1.

Item 9

A novel additive, as described in item 1, wherein the amount of said mixture of said compound A and said compound C, which should be added to crude oil for high temperature naphthenic acid corrosion inhibition, is from about 1 ppm to about 5000 ppm, preferably from about 1 ppm to about 300 ppm.

Item 10

A novel additive, as described in item 9 wherein the ratio of said compound A to said compound C, by weight, is from about 1:1 to about 4:1.

Item 11

A process for naphthenic acid corrosion inhibition and/or sulphur corrosion inhibition of metallic surfaces of any of the hydrocarbon, processing units, with said processing units comprising distillation columns, strippers, trays, pump around piping and related equipments, using inhibitor combination compound such as, any mixture from two mixtures, such as, a mixture of two compounds A and B of items 1, 2, 7 and 8, or a mixture of two compounds A and C of items 1, 2, 9 and 10, comprising the steps of:

a. heating the hydrocarbon containing naphthenic acid and/or sulphur compounds, to vapourize a portion of said hydrocarbon;
b. condensing a portion of the hydrocarbon vapours, passing through said hydrocarbon processing unit, to produce a condensed distillate;
c. adding to said distillate, before said condensed distillate is returned to said hydrocarbon processing unit or collected as a product, from about 1 ppm to about 5000 ppm, preferably from about 1 ppm to 300 ppm of said inhibitor combination compound such as, any mixture from two mixtures, such as, said mixture of two compounds A and B of items 1, 2, 7 and 8, or said mixture of two compounds A and C of items 1, 2, 9 and 10, wherein ratio by weight of A to B is from about 1:1 to about 4:1 and ratio of A to C is from about 1:1 to about 4:1;
d. allowing said condensed distillate containing said inhibitor combination compound such as, any mixture from two mixtures, such as, said mixture of two compounds A and B of items 1, 2, 7 and 8, or said mixture of two compounds A and C of items 1, 2, 9 and 10, to contact said metallic surfaces of said hydrocarbon processing unit, to form a protective film on said surfaces whereby each surface is inhibited against corrosion; and
e. allowing said condensed distillate to return to said hydrocarbon processing unit, or to be collected as said product.

Although the invention has been described with reference to certain preferred embodiments, the invention is not meant to be limited to those preferred embodiments. Alterations to the preferred embodiments described are possible without departing from the spirit of the invention. However, the process and composition described above are intended to be illustrative only, and the novel characteristics of the invention may be incorporated in other forms without departing from the scope of the invention.

The invention claimed is:

1. A novel additive composition for naphthenic acid corrosion inhibition comprising a chemical mixture of:

i) a corrosion inhibiting amount of an olefin phosphorous sulphur compound A, and ii) a corrosion inhibiting amount of a compound selected from a group consisting of:

iia) a thiophosphorous sulphur compound B, and iib) a thiophosphorous sulphur compound C, wherein said olefin phosphorous sulphur compound A is a reaction product of reacting olefin with phosphorous pentasulphide, to form a reaction comprising olefin phosphorous sulphur compound A, wherein a molar ratio of said olefin to said phosphorous pentasulphide is between 1:0.05 and 1:1.5, and wherein said reaction of the olefin with the phosphorous pentasulphide is carried out (a) in multi-step heating, (b) in presence of catalytic amount of sulphur, and (c) under nitrogen as purging, and thereby resulting into said compound A; and wherein said thiophosphorous sulphur compound B comprises a phosphorous thioacid ester of the formula 1

Formula 1

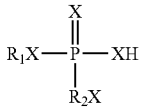

wherein X comprises at least one of sulphur and oxygen and at least one X comprises sulphur and wherein $R_1$ and $R_2$ are selected from hydrogen and hydrocarbyl having 5 to 18 carbon atoms, and includes mono-, di-, mixtures thereof;

wherein said compound C of formula 2 is obtained by reacting said compound B with an oxide selected from the group consisting of ethylene oxide, propylene oxide and butylene oxide and wherein the formula 2 comprises resulting compound C obtained after reaction of said compound B with said ethylene oxide, and includes mono-, di-, mixtures thereof;

Formula 2

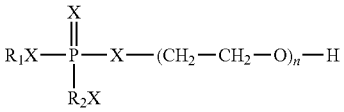

$n$ = 1 to 10.

2. The novel additive composition as claimed in claim 1, wherein said olefin comprises polyisobutylene, which is at least one of highly reactive and normal.

3. The novel additive composition, as claimed in claim 1, wherein said olefin phosphorus sulphur compound A is arrived at, by stirring and heating said reaction mixture of claim 1, to 160° C. under nitrogen gas purging, maintaining said reaction mixture between about 160° C. to about 180° C. for a period of about 1 hour to about 2 hours, raising a temperature of said reaction mixture to from about 185° C. to about 250° C., and maintaining said reaction mixture with said raised temperature for between about 1 to about 24 hours, cooling the reaction mixture to 100° C. and purging nitrogen gas into a reaction vessel to drive out hydrogen sulphide gas, thereby resulting in said olefin phosphorous sulfur compound A.

4. The novel additive composition according to claim 1 wherein said olefin has between 10 and 1000 carbon atoms.

5. The novel additive composition according to claim 1 wherein said olefin has a molecular weight of from 200 to 10,000.

6. The novel additive composition according to claim 1 wherein said olefin has a molecular weight of about 950 to about 1300.

7. The novel additive composition, as claimed in claim 1, wherein the amount of said mixture of said compound A and said compound B, which is added to crude oil for high temperature naphthenic acid corrosion inhibition, is from about 1 ppm to about 5000 ppm.

8. The novel additive composition, as claimed in claim 7, wherein a ratio of said compound A to said compound B, by weight, is from about 1:1 to about 4:1.

9. The novel additive composition, as claimed in claim 1, wherein the amount of said mixture of said compound A and said compound C, which is added to crude oil for high temperature naphthenic acid corrosion inhibition, is from about 1 ppm to about 5000 ppm.

10. The novel additive composition, as claimed in claim 9 wherein a ratio of said compound A to said compound C, by weight, is from about 1:1 to about 4:1.

11. A process for at least one of naphthenic acid corrosion inhibition and sulphur corrosion inhibition of a metallic surface of any of hydrocarbon processing units, wherein said processing units comprise at least one of a distillation column, a stripper, a tray, a pump around piping, and related equipment, using an inhibitor combination compound selected from a group comprising a mixture of said two compounds A and B, and said two compounds A and C of claim 1, comprising the steps of:

a. heating a hydrocarbon containing at least one of the naphthenic acid and sulphur compound, to vapourize a portion of said hydrocarbon;

b. condensing a portion of the hydrocarbon vapours, passing through said hydrocarbon processing unit, to produce a condensed distillate;

c. adding to said distillate, before said condensed distillate is at least one of returned to said hydrocarbon processing unit and collected as a product, from about 1 ppm to about 5000 ppm of said inhibitor combination compound, wherein a ratio by weight of said compound A to said compound B is from about 1:1 to about 4:1, and a ratio of said compound A to said compound C is from about 1:1 to about 4:1;

d. allowing said condensed distillate containing said inhibitor combination compound, to contact said metallic surface of said hydrocarbon processing unit, to form a protective film on said surface whereby said surface is inhibited against corrosion; and e. allowing said condensed distillate to be at least one of returned to said hydrocarbon processing unit and collected as said product.

12. The novel additive composition as claimed in claim 1, wherein said molar ratio of said olefin to said phosphorous pentasulphide is about 1:1.

13. The novel additive composition as claimed in claim 3, wherein the temperature of said reaction mixture is raised to between about 190° C. to about 230° C.

14. The novel additive composition as claimed in claim 3, wherein the temperature of said reaction mixture is raised to between about 210° C. to about 225° C.

15. The novel additive composition as claimed in claim 3, wherein said reaction mixture is maintained at said raised temperature for between about 6 and about 10 hours.

16. The novel additive composition, as claimed in claim 7, wherein an amount of said mixture of said compound A and said compound B, which is added to crude oil for high temperature naphthenic acid corrosion inhibition, is from about 1 ppm to about 300 ppm.

17. The novel additive composition, as claimed in claim 9, wherein an amount of said mixture of said compound A and said compound C, which is added to crude oil for high temperature naphthenic acid corrosion inhibition, is from about 1 ppm to about 300 ppm.

18. The process as claimed in claim 11, wherein said inhibitor combination compound in step c) is added to said distillate in an amount varying from about 1 ppm to about 300 ppm.

19. A method of using naphthenic acid corrosion inhibiting composition of claim 1 for at least one of naphthenic acid corrosion inhibition and sulphur corrosion inhibition of a metallic surface of hydrocarbon processing units comprising at least one of a distillation column, a stripper, a tray, a pumparound piping, and related equipment, wherein the composition consists of a chemical mixture of:

i) a corrosion inhibiting amount of said olefin phosphorous sulphur compound A, which is produced by reacting olefin with phosphorous pentasulphide in presence of a catalytic amount of sulphur, to form a reaction mixture, with a molar ratio of said olefin to said phosphorous pentasulphide being between 1:0.05 and 1:1.5, and ii) a corrosion inhibiting amount of said compound selected from the group consisting of:

iia) said thiophosphorous sulphur compound B, and iib) said thiophosphorous sulphur compound C; and wherein the method comprises the steps of:

a. heating a hydrocarbon containing at least one of the naphthenic acid and sulphur compound, to vapourize a portion of said hydrocarbon;

b. condensing a portion of the hydrocarbon vapours, passing through said hydrocarbon processing unit, to produce a condensed distillate;

c. adding to said distillate, before said condensed distillate is at least one of returned to said hydrocarbon processing unit and collected as a product, said inhibiting composition;

d. allowing said condensed distillate containing said composition, to contact said metallic surface of said hydrocarbon processing unit, to form a protective film on said surface whereby said surface is inhibited against corrosion; and e. allowing said condensed distillate to be at least one of returned to said hydrocarbon processing unit and collected as said product.

20. The method as claimed in claim 19, wherein from about 1 ppm to about 5000 ppm of said composition is added in said step c.

21. The method as claimed in claim 19, wherein a ratio by weight of said compound A to said compound B is from about 1:1 to about 4:1, and a ratio by weight of said compound A to said compound C is from about 1:1 to about 4:1 in said step c.

22. The method as claimed in claim 19, wherein said olefin comprises polyisobutylene, which is at least one of highly reactive and normal.

23. The method as claimed in claim 19, wherein said olefin has between 10 and 1000 carbon atoms.

24. The method as claimed in claim 19, wherein said olefin has a molecular weight of from 200 to 10,000.

25. The method as claimed in claim 19, wherein an amount of said mixture of said compound A and said compound B, or of said mixture of said compound A and said compound C, which is added to crude oil for the corrosion inhibition varies from about 1 ppm to about 300 ppm.

* * * * *

UNITED STATES PATENT AND TRADEMARK OFFICE

CERTIFICATE OF CORRECTION

PATENT NO. : 9,115,319 B2
APPLICATION NO. : 12/677791
DATED : August 25, 2015
INVENTOR(S) : Mahesh Subramaniyam It is certified that error appears in the above-identified patent and that said Letters Patent is hereby corrected as shown below:

IN THE CLAIMS

Claim 1, col. 21, line 12, replace “reaction comprising olefin” with --reaction mixture comprising said olefin--

Claim 1, col. 21, line 18, replace “nitrogen as” with --nitrogen gas--

Signed and Sealed this
Fifth Day of January, 2016

Michelle K. Lee

Michelle K. Lee
*Director of the United States Patent and Trademark Office*